United States Patent [19]

Klawitter

[11] 4,363,494

[45] Dec. 14, 1982

[54] ROLLER SKATE

[75] Inventor: Ronald R. Klawitter, Hermann, Mo.

[73] Assignee: Steven Manufacturing Company, Hermann, Mo.

[21] Appl. No.: 159,775

[22] Filed: Jun. 16, 1980

[51] Int. Cl.[3] ..... A63C 17/02

[52] U.S. Cl. ..... 280/11.28; 36/115

[58] Field of Search ..... 280/11.19, 11.27, 11.22, 280/11.28, 11.23, 11.1 R; 36/115; 411/116, 117, 119, 83

[56] References Cited

U.S. PATENT DOCUMENTS

| | | | |
|---|---|---|---|
| 2,461,128 | 2/1949 | Reich | 280/11.28 |
| 3,332,182 | 7/1967 | Mark | 411/116 |
| 3,377,079 | 4/1968 | Barczak | 280/11.28 |
| 3,478,802 | 11/1969 | Poccard | 411/116 |
| 3,738,673 | 6/1973 | Iseman | 280/11.28 |
| 4,058,323 | 11/1977 | Ware, Jr. | 280/11.28 |
| 4,146,241 | 3/1979 | Stevenson | 280/11.28 |
| 4,150,499 | 4/1979 | Wang | 36/115 |

*Primary Examiner*—Joseph F. Peters, Jr.
*Assistant Examiner*—Ross Weaver
*Attorney, Agent, or Firm*—Polster, Polster and Lucchesi

[57] ABSTRACT

A steerable roller skate of the shoe skate variety has an elongated one-piece sole plate in the form of an open topped dish with a bottom wall, a side wall and a continuous rim, outturned along the long sides thereof and, in the preferred form, rising from the toe end toward the heel end to join with a heel-less shoe sole uninterruptedly around the sole. A pair of support shaft bosses extend upwardly from the bottom wall, each with an open-ended vertical passage and each crowned with a lip around the passage defining a non-circular socket to receive the head of a bolt-shaft. The underside of the bottom wall has a pair of bearing tongue seats formed in it. Neither the shaft bosses nor the seats have a reentrant surface with respect to the adjacent surfaces of the bottom wall.

1 Claim, 12 Drawing Figures

ROLLER SKATE

BACKGROUND OF THE INVENTION

Roller skate sole plates are conventionally made flat, as illustrated in U.S. Pat. to Ware, No. 4,058,323, although ice skates occasionally have stepped platforms, as exemplified by Zuuring, U.S. Pat. No. 4,150,837. In either event, there is a gap between the sole plate and a part of the shoe. Furthermore, in sole plates known heretofore that involve the use of wheel trucks mounted on a shaft and supported for tilting movement by a strut or tongue projecting into a socket made integral with the sole plate, the shaft has been threaded into a boss, and both the boss and the socket have been formed at an angle to the sole plate. This also is illustrated in U.S. Pat. No. 4,058,323, and in a somewhat different form, in U.S. Pat. No. 4,159,830.

One of the objects of this invention is to provide a shoe skate with a sole plate so constructed as to permit a shoe sole to be joined uninterruptedly, with neither heel nor gap.

Another object is to provide a sole plate adapted to use with a wheel truck mounted on a shaft and supported for tilting movement by a tongue projecting into a socket made integral with the sole plate, that can be produced in a simple two-piece mold.

Other objects will become apparent to those skilled in the art in the light of the following description and accompanying drawing.

SUMMARY OF THE INVENTION

In a steerable roller skate of the shoe skate variety a one-piece sole plate is provided in the form of an open topped dish with a bottom wall, a side wall and, at the upper edge of the side wall, a continuous rim preferably rising from the toe end toward the heel end to meet with a heel-less shoe sole uninterruptedly around the sole. In the preferred embodiment, a pair of support shaft bosses extend upwardly from the bottom wall, each with an open-ended vertical passage and each crowned with a lip around the passage defining a non-circular seat. A pair of bearing tongue seats are formed in the bottom wall, the seats and shaft bosses having no reentrant surface with respect to the adjacent surfaces of the bottom wall.

DESCRIPTION OF THE PREFERRED EMBODIMENT

Figure 1:
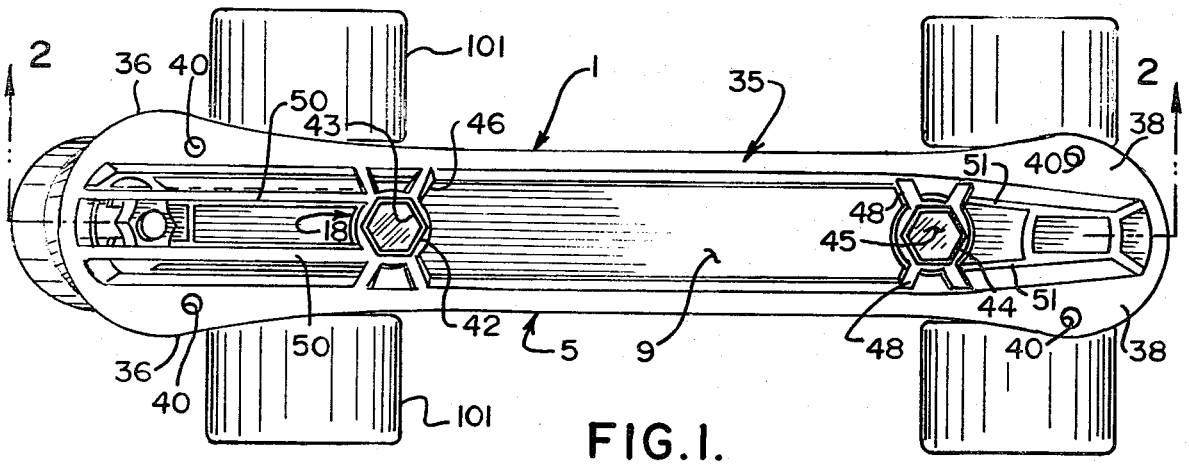
FIG. 1 is a top plan view of a roller skate illustrating one embodiment of this invention, without a shoe.

Referring now to the drawing for an illustrative embodiment of this invention, reference numeral 1 indicates a steerable roller skate of the type to which a shoe 2 is attached. The skate 1 includes an elongated sole plate 5 in the form of an open-topped dish with a bottom wall 7, a continuous side wall 15, and a shoe engaging rim 35.

The bottom wall 7 includes a central section 9, a toe section 11 and a heel section 13.

The side wall 15 includes a level toe part 16 and an upwardly rearwardly rising part 17.

Between the central section 9 and the toe section 11 of the bottom wall, and integral with the bottom wall, is a toe end support shaft boss 18 with a vertical bore 19. Between the central section 9 and the heel section 13, and integral with the bottom wall, is a heel end support shaft boss 20 with a vertical bore 21.

Also integral with the bottom wall, in the toe section 11, is a front bearing tongue seat 22, and in the heel section 13, a rear bearing tongue seat 25. The tongue seats are sometimes referred to in the art as rocker holes.

Forwardly of the front bearing tongue seat 22, at the forward end of the toe section of the bottom wall, is an upwardly forwardly sloping web 27, extending between the bottom wall and the frontmost part of the side wall 15. A stop bolt aperature 29 extends through the sloping web 27, with its axis perpendicular to the plane of the surface of the web. A stop bolt 30 extends through the aperature 29. The stop bolt 30 has a head 32 at one end and a nut 31 threaded on its other, to mount a conventional stop 33.

The shoe engaging rim 35 has outwardly flaring toe wings 36 and heel wings 38 through which shoe attachment rivet holes 40 extend.

The toe end shaft boss 18 is crowned by a lip 42 defining a non-circular, in this embodiment hexagonal, seat 43. The heel end shaft boss 20 is crowned by a lip 44 defining a hexagonal seat 45.

Figure 5:
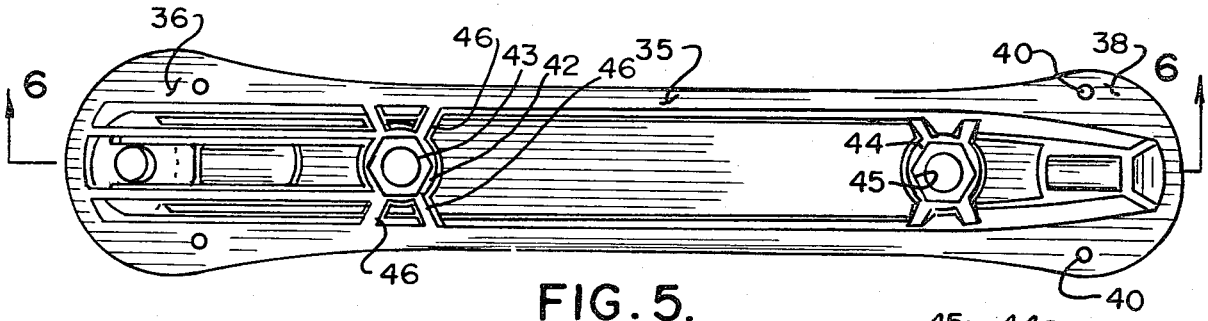
FIG. 5 is a top plan view of the sole plate alone.
Figure 6:
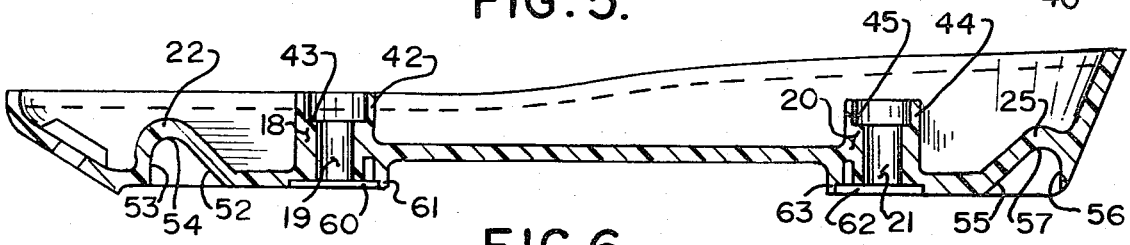
FIG. 6 is sectional view taken along the line 6—6 of FIG. 5.
Figure 7:
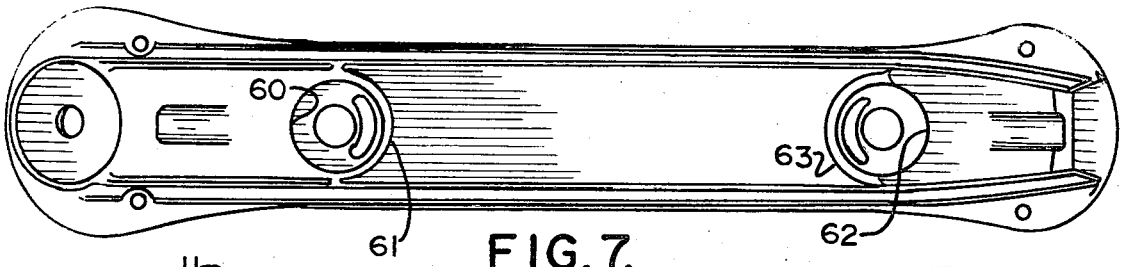
FIG. 7 is a bottom plan view of the sole plate.
Figure 8:
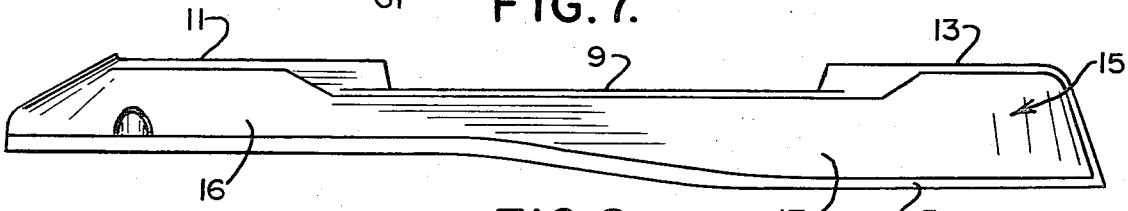
FIG. 8 is a view in side elevation of the sole plate inverted.

On the upper side of the bottom wall 7, extending from the side wall 15 to the toe boss, are reinforcing cross ribs 46 and, to the heel boss, cross ribs 48. Parallel longitudinal ribs 50 extend forwardly from the toe boss 18 to the toe part of the side wall 15, as shown particularly in FIGS. 1 and 5. Spaced ribs 51 extend rearwardly from heel boss 20 convergently to the end of the rear bearing tongue seat 25, then divergently to the rim 35.

The toe end tongue seat is defined by an upwardly forwardly sloping wall part 52, a vertical wall part 53, and a domed bearing area 54. Heel end tongue seat is defined by an upwardly rearwardly sloping wall part 55, a vertical wall part 56 and a domed bearing area 57.

On the undersurface of the toe end boss is a seat 60 defined by a lip 61. A seat 62 on the underside of the heel end boss 20 is defined by a lip 63.

Figure 3:
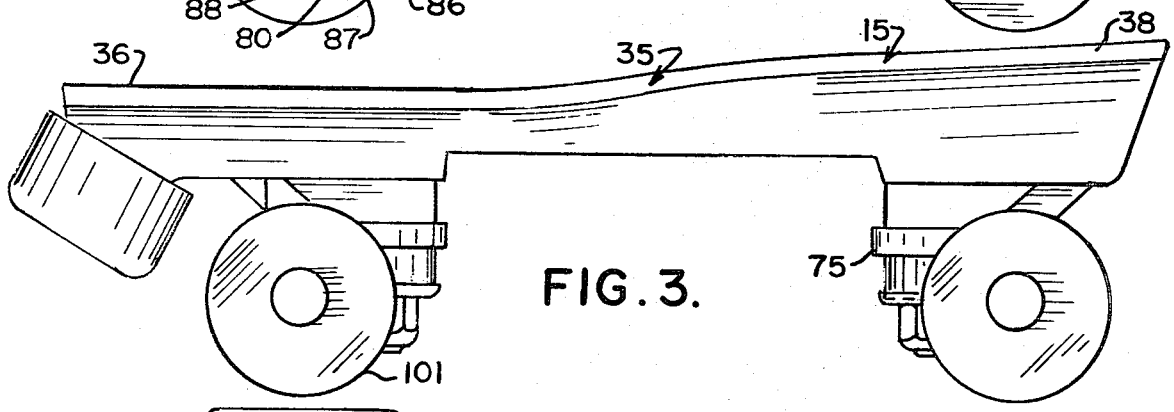
FIG. 3 is a view in side elevation.
Figure 4:
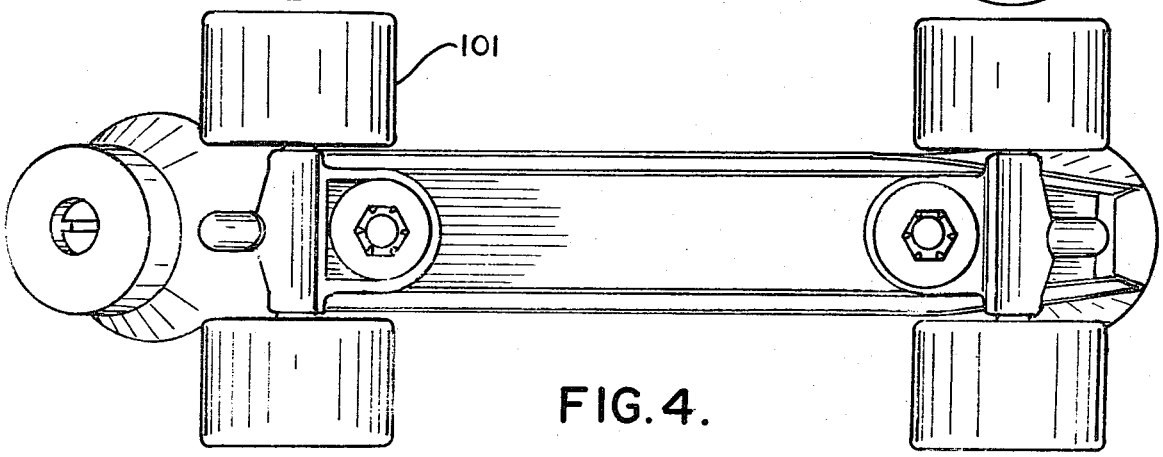
FIG. 4 is a bottom plan view.
Figure 9:
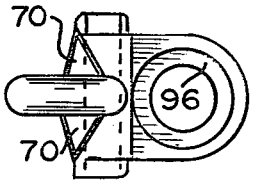
FIG. 9 is a top plan view of a slightly different embodiment of wheel truck from that shown in FIGS. 2–4.
Figure 10:
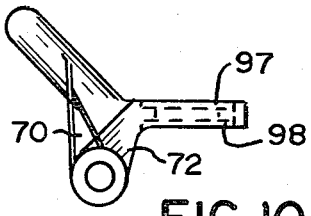
FIG. 10 is a view in side elevation of the wheel truck of FIG. 9.
Figure 11:
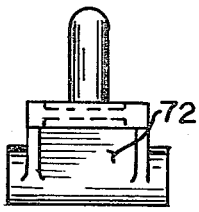
FIG. 11 is a view in front elevation of the wheel truck.
Figure 12:
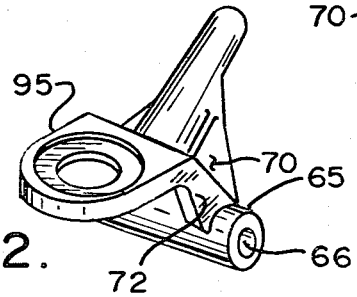
FIG. 12 is a view in perspective of the wheel truck.

Toe and heel end trucks 64 can be identical. Each has an axle journal 65 with an axle receiving bore 67, a tongue 69, reinforcing gussets 70, an offsetting bracket 72 and a mounting platform, indicated in FIGS. 2 and 3 by the reference numeral 75, and in the embodiment shown in FIGS. 9 and 12 by the reference numeral 95. In the embodiment of truck shown in FIGS. 2–4, the mounting platform 75 has an integral upper locating boss 77 and a lower boss 78. In this embodiment, the mounting platform 75 is sandwiched between an upper rubber mounting sleeve 79 and a lower rubber mounting sleeve 80. The upper sleeve 79 is molded with a seat 81 in its lower surface and the lower sleeve 80, with a seat 82 in its upper surface to receive the upper and lower bosses 77 and 78 respectively. In the embodiment of truck shown in FIGS. 9 through 12, the mounting platform has an annular web 96, defining with upper and lower surfaces of the platform an upper seat 97 and a lower seat 98, in which cylindrical rubber mounting sleeves identical with sleeves 79 except without the seats, are seated.

Both trucks are mounted on support shaft bolts 83, each with a hex head 84 seated closely within the seats 43 and 45 of the bosses 18 and 20 respectively, a smooth shaft 85 extending through the bosses 18 and 20, through the sleeves 79 and 80 and the mounting platform 75 or 95 as the case may be, and a threaded lower end portion 86 extending through a central aperature of a dished washer 88. A nut 87 is threaded to bear tightly against the underside of the washer 88.

An axle 100 journaled in bore 67 and wheels 101 are conventional.

Figure 2:
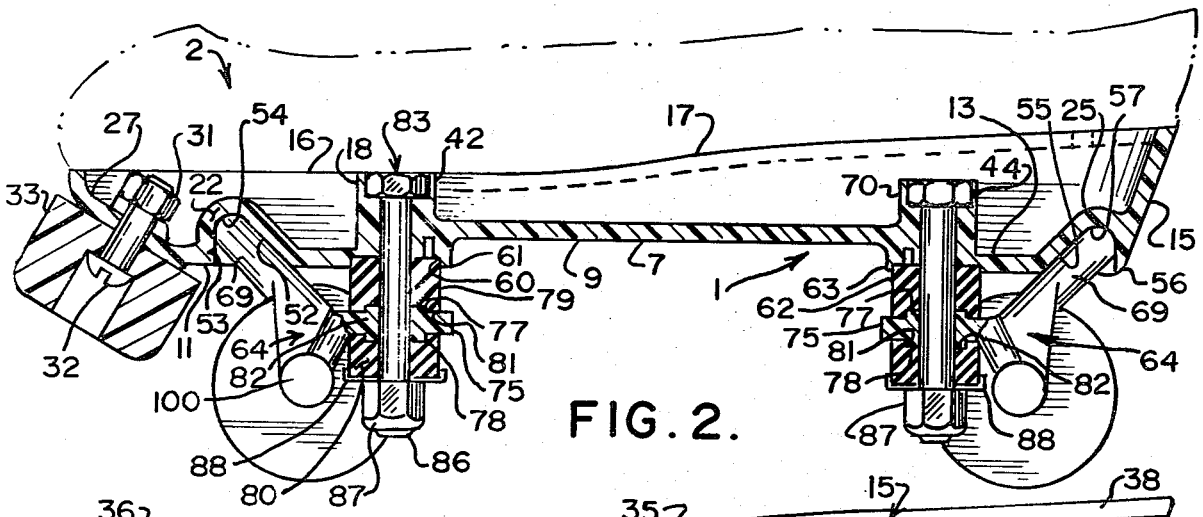
FIG. 2 is a sectional view taken along the line 2—2 of FIG. 1, with a shoe upper indicated fragmentarily.

The tongue 69 of the front wheel truck is mounted in front bearing tongue seat 22, and the tongue 69 of the rear wheel truck is mounted in the rear bearing tongue seat, as shown in FIG. 2, for limited skewing of the axles with respect to the longitudinal axis of the skate as is well known in the steerable roller skate art.

As will be readily apparent from the drawings, there are no reentrant angles in the bottom wall, support shaft bosses 18 and 20, or bearing seats 22 and 25. There are no internal threads in any of the sole plate parts. Accordingly, the sole plate can be molded in a simple two-pieces mold with a straight draw. The stop bolt aperature 29 is designed to be made with split straight core pins, the upper half of the opening being formed by a semicircular pin in the lower half of the mold, and the lower half of the aperature being formed by a semicircular pin in the upper half of the mold.

As can be seen in FIG. 2, the shoe 2 can have a sole, but requires no heel, and the heel-less sole can be joined uninterruptedly, in the sense that there are no gaps, to the rim 35. This produces a less expensive and more finished appearing shoe skate.

Numerous variations in the construction of the skate of this invention within the scope of the appended claims will occur to those skilled in the art in the light of the foregoing disclosure. The sole plate can be made of either plastic or metal, but in any event, can easily be made in one piece in a simple molding operation. The various reinforcing ribbing, and the exact configuration of the sole plate can be varied widely, as can the construction of the truck. The feature of the lack of reentrant angles, permitting the use of a simple two-piece mold with a straight draw, can be used with a plane-topped platform, as distinguished from the contoured-rimmed sole plate of the preferred embodiment, and the contoured-rimmed sole plate can be provided on a conventional wheel truck supporting structure, although the combination of the two produces a superior product, economically. These are merely illustrative.

Having thus the invention what is claimed and desired to be secured by Letters Patent is:

1. In a steerable roller skate of the shoe skate variety, the improvement comprising an elongated, one-piece sole plate in the form of an open-topped dish with a bottom wall and a side wall and, at the upper edge of said side wall, a continuous rim, rising from the toe end toward the heel end to meet with a heel-less shoe sole uninterruptedly around said sole, a pair of support-shaft bosses extending upwardly from said bottom wall no higher than the said rim, each with an open-ended, smooth-walled, vertical passage, each boss being crowned with a lip around said passage defining a non-circular seat to receive the complementarily shaped head of a bolt threaded at its other end and each having reinforcing cross ribs integral with said bottom wall and integral with and extending between said bosses and said side wall, and a pair of bearing tongue seats formed in said botton wall, said seats and bosses having no reentrant surface with respect to the adjacent surfaces of the bottom wall, whereby the sole plate can be made in a simple two-piece mold with a straight draw.

* * * * *